US011039659B2

(12) United States Patent
Hopkins

(10) Patent No.: US 11,039,659 B2
(45) Date of Patent: Jun. 22, 2021

(54) SOLE STRUCTURE FOR ARTICLE OF FOOTWEAR

(71) Applicant: NIKE, Inc., Beaverton, OR (US)

(72) Inventor: Timothy P. Hopkins, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 115 days.

(21) Appl. No.: 16/123,756

(22) Filed: Sep. 6, 2018

(65) Prior Publication Data

US 2019/0069630 A1 Mar. 7, 2019

Related U.S. Application Data

(60) Provisional application No. 62/555,234, filed on Sep. 7, 2017.

(51) Int. Cl.
*A43B 13/14* (2006.01)
*A43B 13/18* (2006.01)
(Continued)

(52) U.S. Cl.
CPC ..... *A43B 13/146* (2013.01); *A43B 13/12* (2013.01); *A43B 13/141* (2013.01);
(Continued)

(58) Field of Classification Search
CPC ..... A43B 3/0036; A43B 5/02; A43B 13/141; A43B 13/146; A43B 13/183; A43C 15/162
See application file for complete search history.

(56) References Cited

U.S. PATENT DOCUMENTS 3,100,354 A * 8/1963 Lombard ..... A43B 13/184 36/25 R
4,372,058 A * 2/1983 Stubblefield ..... A43B 13/143 36/114
(Continued)

FOREIGN PATENT DOCUMENTS

EP 2213189 A1 8/2010

OTHER PUBLICATIONS

European Patent Office (ISA), International Preliminary Report on Patentability for International Application No. PCT/US2018/049871, dated Mar. 19, 2020.
(Continued)

*Primary Examiner* — Sharon M Prange
(74) *Attorney, Agent, or Firm* — Honigman LLP; Matthew H. Szalach; Jonathan O'Brien

(57) ABSTRACT

A sole structure for an article of footwear is provided and includes a plate having a concave ground-engaging surface extending between a medial side of the plate and a lateral side of the plate and movable between a relaxed state and a flexed state. The concave surface has an increased radius when moved from the relaxed state to the flexed state. A first ground-engaging member extends from the plate proximate to the medial side of the plate and a second ground-engaging member extends from the plate proximate to the lateral side of the plate. The second ground-engaging member is spaced apart from the first ground-engaging member by a first distance when the plate is in the relaxed state and is spaced apart from the first ground engaging member by a second distance greater than the first distance when the plate is in the flexed state.

18 Claims, 10 Drawing Sheets

(51) Int. Cl.

| | |
|---|---|
| ***A43C 15/16*** | (2006.01) |
| ***A43B 13/22*** | (2006.01) |
| ***A43B 13/12*** | (2006.01) |
| *A43B 13/04* | (2006.01) |
| *A43B 13/02* | (2006.01) |

(52) U.S. Cl.
CPC ..... *A43B 13/145* (2013.01); *A43B 13/183* (2013.01); *A43B 13/223* (2013.01); *A43C 15/162* (2013.01); *A43B 13/026* (2013.01); *A43B 13/04* (2013.01)

(56) References Cited

U.S. PATENT DOCUMENTS 4,697,361 A * 10/1987 Ganter ..... A43B 13/186 36/28
4,741,114 A 5/1988 Stubblefield
5,185,943 A * 2/1993 Tong ..... A43B 5/00 36/27
5,617,653 A * 4/1997 Walker ..... A43B 13/26 36/128
8,056,267 B2 * 11/2011 Auger ..... A43B 5/02 36/114
8,181,364 B2 * 5/2012 Mayden ..... A43B 7/144 36/103
8,453,354 B2 * 6/2013 Baker ..... A43C 15/14 36/134
2002/0152642 A1 * 10/2002 Chu ..... A43B 13/10 36/113
2007/0240331 A1 * 10/2007 Borel ..... A43B 21/26 36/28
2007/0266597 A1 * 11/2007 Jones ..... A43B 5/00 36/59 C
2009/0113758 A1 * 5/2009 Nishiwaki ..... A43B 13/127 36/88
2010/0199523 A1 8/2010 Mayden et al.
2013/0067774 A1 * 3/2013 Auger ..... A43B 13/141 36/103

OTHER PUBLICATIONS

International Searching Authority, International Search Report and Written Opinion for PCT Application No. PCT/US2018/049871, dated Nov. 28, 2018.

* cited by examiner

SOLE STRUCTURE FOR ARTICLE OF FOOTWEAR

CROSS REFERENCE TO RELATED APPLICATIONS

This non-provisional U.S. Patent Application claims priority under 35 U.S.C. § 119(e) to Provisional U.S. Patent Application No. 62/555,234 entitled "Sole Structure for Article of Footwear," filed on Sep. 7, 2017.

FIELD

The present disclosure relates generally to an article of footwear and more particularly to a sole structure for an article of footwear.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. For example, a sole structure may include a midsole and an outsole. The midsole is generally disposed between the outsole and the upper and provides cushioning for the foot. The midsole may include a pressurized, fluid-filled chamber that compresses resiliently under an applied load to cushion the foot by attenuating ground-reaction forces. The outsole provides abrasion-resistance and traction with the ground surface and may be formed from rubber or other materials that impart durability and wear-resistance, as well as enhancing traction with the ground surface.

While known outsoles have proven acceptable for their intended purposes, a continuous need for improvement in the relevant art remains. For example, a need exists for an outsole that provides improved traction with a ground surface when forces having varying magnitude and/or direction are applied. A need also exists for an article of footwear having improved overall comfort and fit while providing such improved traction.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
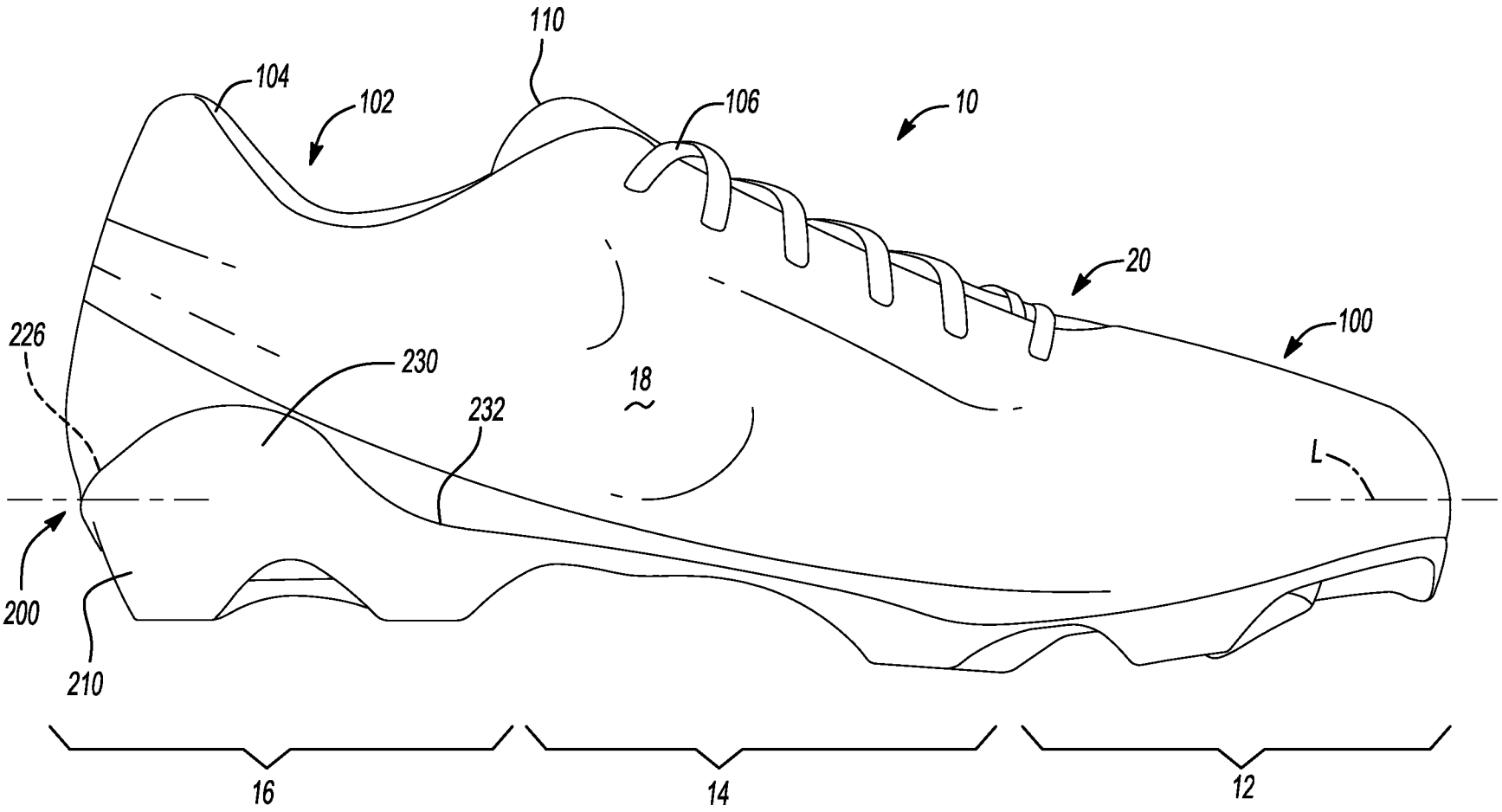
FIG. 1 is a perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear. The sole structure of the article of footwear includes a plate having a concave ground-engaging surface extending between a medial side of the plate and a lateral side of the plate and movable between a relaxed state and a flexed state. The concave surface has an increased radius when moved from the relaxed state to the flexed state. The sole structure also includes a first ground-engaging member extending from the plate proximate to the medial side of the plate. The sole structure further includes a second ground-engaging member extending from the plate proximate to the lateral side of the plate. The second ground-engaging member is spaced apart from the first ground-engaging member by a first distance when the plate is in the relaxed state and is spaced apart from the first ground engaging member by a second distance greater than the first distance when the plate is in the flexed state.

Implementations of the disclosure may include one or more of the following optional features. In some implementations, the plate of the sole structure includes a convex surface disposed on an opposite side of the plate than the concave surface. The convex surface may extend between the medial side and the lateral side.

In some examples, the sole structure includes a third ground-engaging member that extends from the plate in an area between the first ground-engaging member and the second ground-engaging member. The third ground-engaging member may include a substantially figure-eight shape. The third ground-engaging member may also include a first surface and a second surface that meet at an apex. In some examples, one of the first surface and the second surface is concave and the other of the first surface and the second surface is convex.

In some configurations, the first ground-engaging member extends from the plate along a first axis and the second ground-engaging member extends from the plate along a second axis, the first axis being convergent with the second axis when the plate is in the relaxed state. Here, the first axis may be substantially parallel with the second axis when the plate is in the flexed state. Additionally or alternatively, at least one of the first ground-engaging member and the second ground-engaging member may be disposed at a peripheral edge of the plate.

Another aspect of the disclosure provides a sole structure for an article of footwear. The sole structure includes a plate having a concave ground-engaging surface extending between a medial side of the plate and a lateral side of the plate and movable between a relaxed state and a flexed state. The concave surface has an increased radius when moved from the relaxed state to the flexed state. The sole structure also includes a first ground-engaging member extending from the plate proximate to the medial side of the plate along a first axis. The sole structure further includes a second ground-engaging member extending from the plate proximate to the lateral side of the plate along a second axis, the second axis being convergent with the first axis when the plate is in the relaxed state.

Implementations of the disclosure may include one or more of the following optional features. In some examples, the plate of the sole structure includes a convex surface disposed on an opposite side of the plate than the concave surface. The convex surface of the plate may extend between the medial side and the lateral side.

In some implementations, the sole structure includes a third ground-engaging member extending from the plate in an area between the first ground-engaging member and the second ground-engaging member. The third ground-engaging member may include a substantially figure-eight shape. Additionally or alternatively, the third ground-engaging member may include a first surface and a second surface that meet at an apex. One of the first surface and the second surface may be concave and the other of the first surface and the second surface may be convex.

In some configurations of the sole structure, the first ground-engaging member is spaced apart from the second ground-engaging member by a first distance when the plate is in the relaxed state and is spaced apart from the second ground engaging member by a second distance greater than the first distance when the plate is in the flexed state. Optionally, the first axis of the sole structure may be substantially parallel with the second axis when the plate is in the flexed state. Additionally or alternatively, at least one of the first ground-engaging member and the second ground-engaging member may be disposed at a peripheral edge of the plate.

Yet another aspect of the disclosure provides a sole structure for an article of footwear. The sole structure includes a plate having a concave ground-engaging surface extending between a medial side of the plate and a lateral side of the plate and movable between a relaxed state and a flexed state. The concave surface has an increased radius when moved from the relaxed state to the flexed state. The sole structure also includes a first ground-engaging member extending from the plate proximate to the medial side of the plate along a first axis. The sole structure further includes a second ground-engaging member extending from the plate proximate to the lateral side of the plate along a second axis, the second axis being substantially parallel with the first axis when the plate is in the flexed state.

Implementations of the disclosure may include one or more of the following optional features. In some configurations, the plate includes a convex surface disposed on an opposite side of the plate than the concave surface. In this configuration, the convex surface may extend between the medial side and the lateral side.

In some examples, the sole structure further includes a third ground-engaging member extending from the plate in an area between the first ground-engaging member and the second ground-engaging member. In this example, the third ground-engaging member may also include a substantially figure-eight shape. Optionally, the third ground-engaging member may further include a first surface and a second surface that meet at an apex. When a first surface and a second surface that meet at an apex, one of the first surface and the second surface may be concave and the other of the first surface and the second surface may be convex.

In some implementations, the first ground-engaging member is spaced apart from the second ground-engaging member by a first distance when the plate is in the relaxed state and is spaced apart from the second ground engaging member by a second distance greater than the first distance when the plate is in the flexed state. Additionally or alternatively, the first axis may be convergent with the second axis when the plate is in the relaxed state. In some examples, at least one of the first ground-engaging member and the second ground-engaging member are disposed at a peripheral edge of the plate.

The details of one or more implementations of the disclosure are set forth in the accompanying drawings and the description below. Other aspects, features, and advantages will be apparent from the description, the drawings, and the claims.

Figure 2:
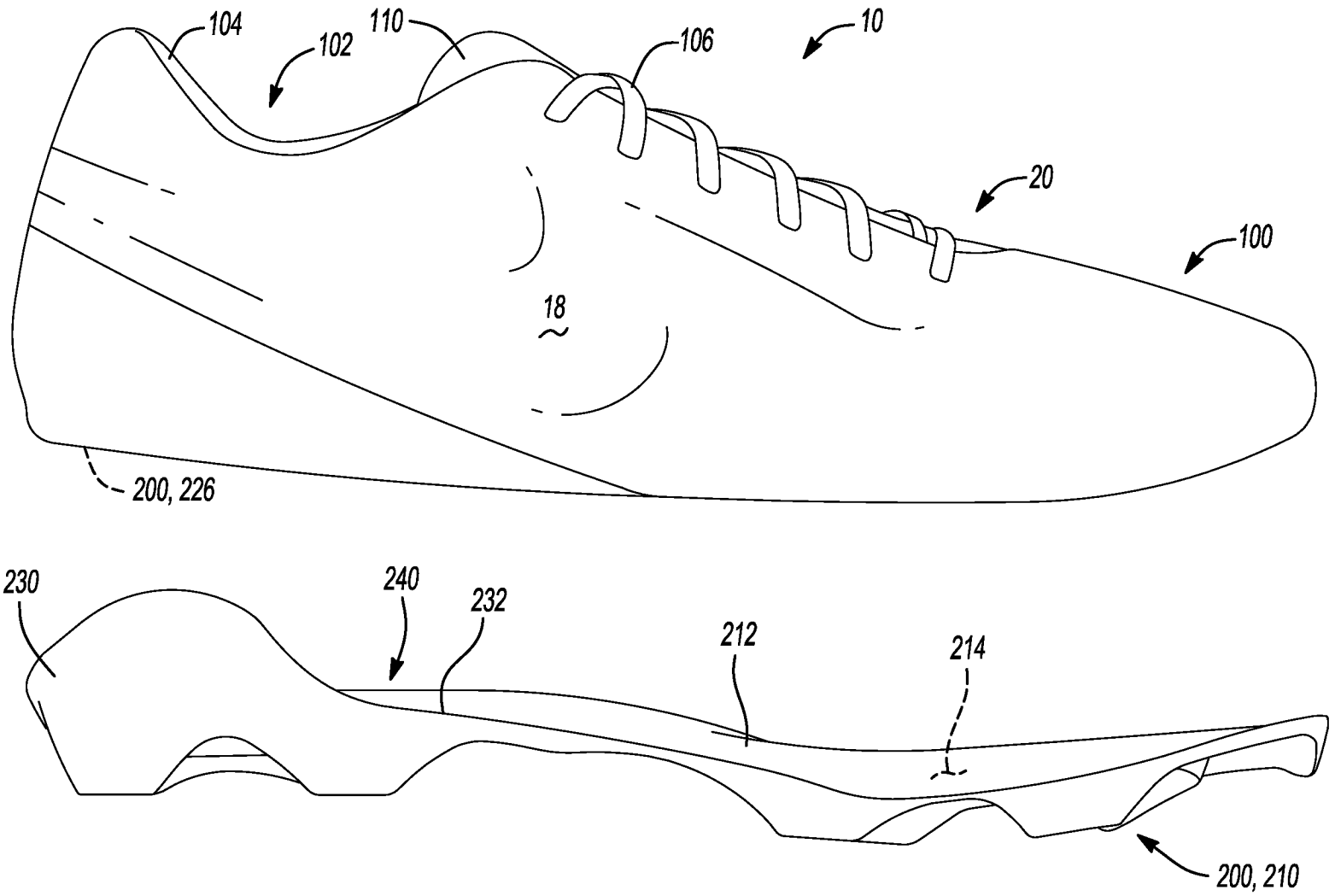
FIG. 2 is an exploded view of the article of footwear of FIG. 1.

Referring to FIGS. 1 and 2, an article of footwear 10 is provided and includes an upper 100 and a sole structure 200 attached to the upper 100. The article of footwear 10 may be divided into one or more portions. The portions may include a forefoot portion 12, a midfoot portion 14, and a heel portion 16. The forefoot portion 12 may correspond with toes and joints connecting metatarsal bones with phalanx bones of a foot. The midfoot portion 14 may correspond with an arch area of the foot, and the heel portion 16 may correspond with rear portions of the foot, including a calcaneus bone. The footwear 10 may include lateral and medial sides 18, 20, respectively, corresponding with opposite sides of the footwear 10 and extending through the portions 12, 14, 16.

The upper 100 includes interior surfaces that define an interior void 102 that receives and secures a foot for support on the sole structure 200. An ankle opening 104 in the heel portion 16 may provide access to the interior void 102. For example, the ankle opening 104 may receive a foot to secure the foot within the void 102 and facilitate entry and removal of the foot to and from the interior void 102. In some examples, one or more fasteners 106 extend along the upper 100 to adjust a fit of the interior void 102 around the foot while concurrently accommodating entry and removal of the foot therefrom. The upper 100 may include apertures such as eyelets and/or other engagement features such as fabric or mesh loops that receive the fasteners 106. The fasteners 106 may include laces, straps, cords, hook-and-loop, or any other suitable type of fastener.

The upper 100 may include a tongue portion 110 that extends between the interior void 102 and the fasteners 106. The upper 100 may be formed from one or more materials that are stitched or adhesively bonded together to form the interior void 102. Suitable materials of the upper may include, but are not limited, textiles, foam, leather, and synthetic leather. The materials may be selected and located to impart properties of durability, air-permeability, wear-resistance, flexibility, and comfort.

In some implementations, the sole structure 200 includes an outsole 210 and a midsole 226 arranged in a layered configuration. For example, the outsole 210 engages with a ground surface during use of the article of footwear 10 and the midsole 226 is disposed between the upper 100 and the outsole 210. The midsole 226 may include a strobel and/or an energy absorbing member such as a foam member and/or a fluid-filled chamber (neither shown) disposed generally between the upper 100 and the outsole 210. For example, the midsole 226 may include a strobel attached to the upper 100 via stitching and may include a foam material disposed between the strobel and the outsole 210. While the midsole 226 may include both a strobel and an energy absorbing member, the midsole will be described hereinafter as including a strobel attached to the upper 100 with the outsole 210 being attached to the strobel and directly to a portion of the upper 100, as shown in FIG. 1.

The sole structure 200 (e.g., the outsole 210 and the midsole 226) defines a longitudinal axis L. In some examples, the sole structure 200 may also incorporate additional layers such as an insole or sockliner (neither shown), which may reside within the interior void 102 of the upper 100 to receive a plantar surface of the foot to enhance the comfort of the footwear 10. In some examples, a sidewall 230 surrounds a perimeter 232 of the outsole 210 and attaches the outsole 210 to a portion of the upper 100.

Figure 3:
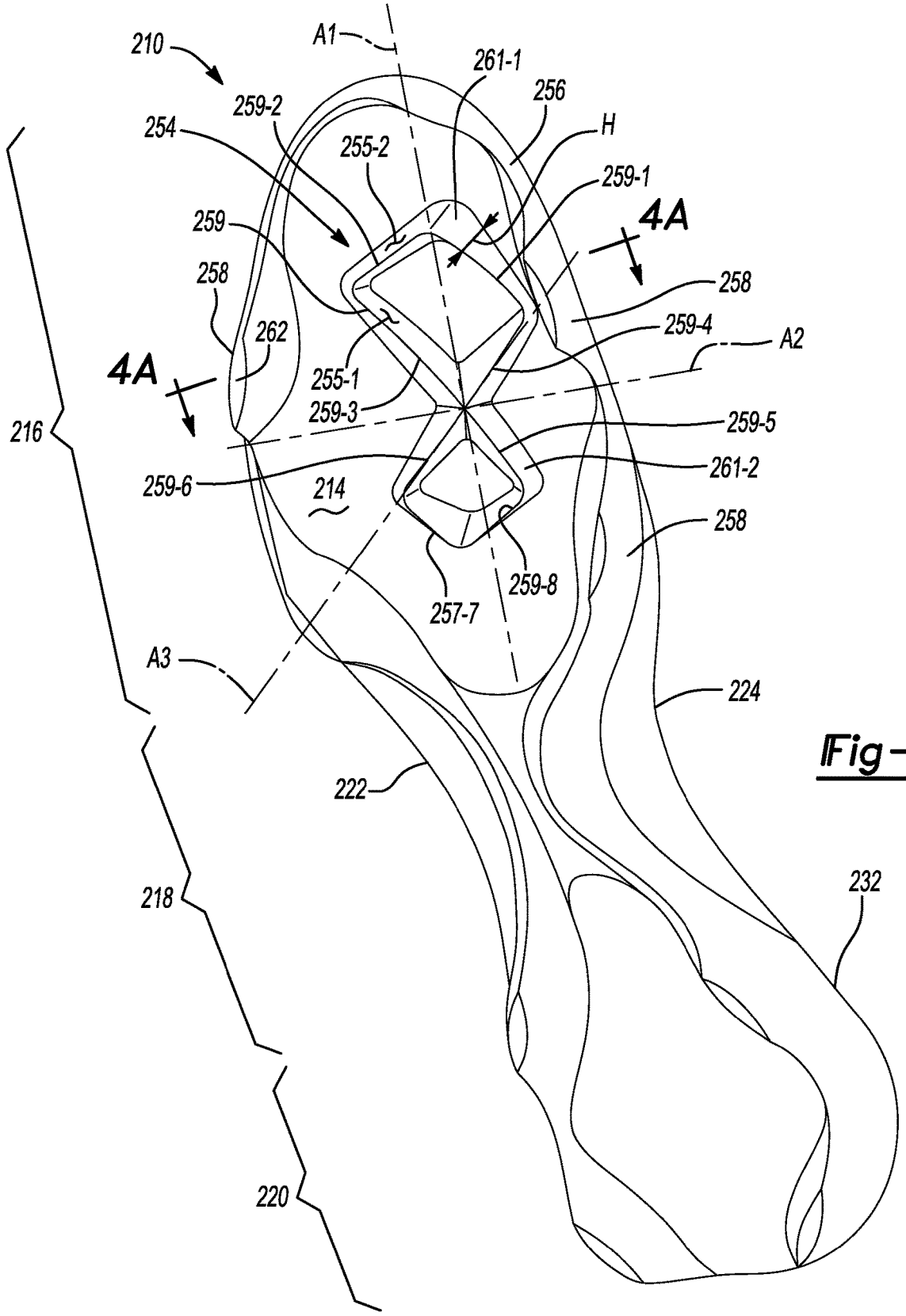
FIG. 3 is a perspective view of an outsole of the article of footwear of FIG. 1 in accordance with principles of the present disclosure.
Figure 4A:
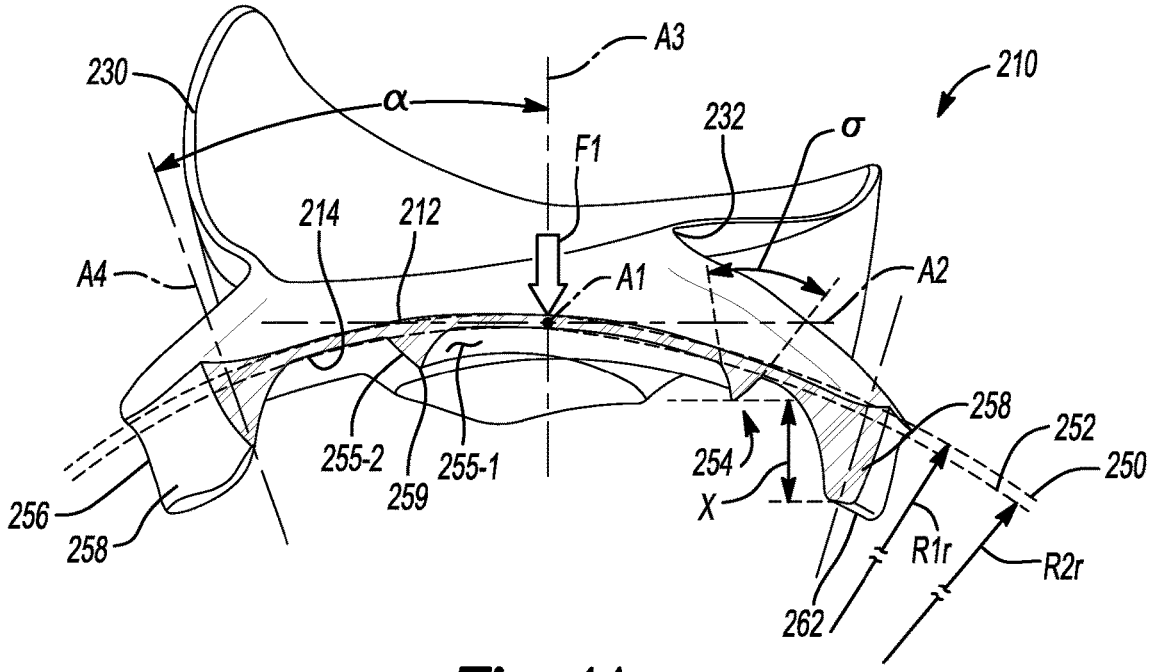
FIG. 4A is a cross-sectional view of the outsole of FIG. 3 taken through the line 4A-4A and showing the outsole in a relaxed configuration.
Figure 4B:
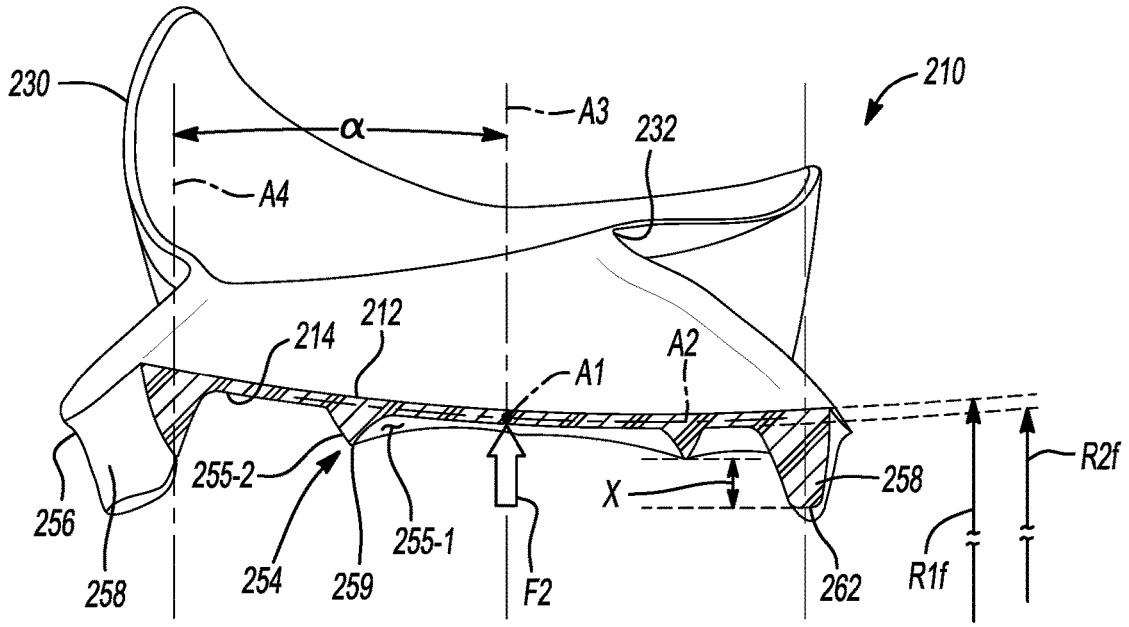
FIG. 4B is a cross-sectional view of the outsole of FIG. 3 showing the outsole in a flexed configuration.

Referring to FIGS. 3-4B, the outsole 210 may attach to one or both of the upper 100 and the midsole 226 and may include an inner surface 212 and an opposite ground-engaging surface 214 disposed in a forefoot portion 216, a midfoot portion 218, or a heel portion 220 of the outsole 210 and extending from a lateral side 222 to a medial side 224 of the outsole 210. The forefoot, midfoot, and heel portions 216, 218, 220 of the outsole 210 may correspond to, or otherwise be aligned with, the forefoot, the midfoot, and the heel portions 12, 14, 16, respectively, along the axis L of the article of footwear 10. The lateral and medial sides 222, 224 may correspond to, or otherwise be aligned with, the lateral and medial sides 18, 20, respectively, of the article of footwear 10.

The inner surface 212 and the ground-engaging surface 214 may be disposed along axes A1 and A2, and may surround an axis A3. The axis A1 may extend from the forefoot portion 12 to the heel portion 16 of the article of footwear 10, and may correspond to, or otherwise be aligned with, the axis L, and the axis A2 may extend from the lateral side 222 to the medial side 224 of the outsole 210. The axis A3 may extend through one of the forefoot, the midfoot, and the heel portions 216, 218, 220 in a direction transverse to (e.g., perpendicular) to the axes A1 and A2. In some examples, the sidewall 230 extends from the perimeter 232 of the outsole 210 and attaches to the midsole 226 and/or to the upper 100. The example of FIG. 1 shows the outsole 210 attaching to the upper 100 proximate to a tip of the forefoot portion 12. The outsole 210 generally provides abrasion-resistance and traction with the ground surface during use of the article of footwear 10. The outsole 210 may be formed from one or more materials that impart durability and wear-resistance, as well as enhance traction with the ground surface. For example, rubber, plastic, and/or carbon fiber may form at least a portion of the outsole 210.

The inner surface 212 may define an arc 250 extending from the lateral side 222 to the medial side 224 of the article of footwear 10. In some implementations, the arc 250 defines a convex profile extending along the axis A1 and having a radius of curvature R1*r*. For example, as illustrated in FIG. 4A, in a resting configuration, the arc 250 may define a convex profile in a cross section taken through a plane intersecting the axis A1 or extending along the axes A2 and A3, whereby the convex profile faces the upper 100. The radius of curvature R1*r* may be between approximately three inches and ten inches. As used herein, "resting configuration" may include a configuration in which the force applied to the inner surface 212 in a direction extending along the axis A3 or transverse to the axes A1, A2 is less than a predetermined threshold. For example, in the resting configuration, the force applied to the inner surface 212 in a direction extending along the axis A3 or transverse to the axes A1, A2 may be less than three pounds-force. In some implementations, the force applied to the inner surface 212 in a direction extending along the axis A3 or transverse to the axes A1, A2 may be substantially equal to zero pounds-force in the resting configuration.

The ground-engaging surface 214 may define an arc 252 extending from the lateral side 222 to the medial side 224 of the article of footwear 10. In some implementations, the arc 252 defines a concave profile extending along the axis A1 and having a radius of curvature R2*r*. For example, as illustrated in FIG. 4A, in the resting configuration, the arc 252 may define a concave profile in a cross section taken through a plane intersecting the axis A1 or extending along the axes A2 and A3. In some implementations, the arc 252 is substantially parallel to the arc 250. In this regard, the radius of curvature R2*r* of the arc 252 may be between approximately two inches and ten inches.

With continued reference to FIGS. 3-4B, the outsole 210 may include one or more central ground-engaging members 254, and a flange 256 having one or more peripheral ground-engaging members 258. The central ground-engaging member(s) 254 may include an inner surface 255-1 and an outer surface 255-2 extending from the ground-engaging surface 214 to a ground-engaging edge 259. The inner and outer surfaces 255-1, 255-2 may extend in a direction transverse to the axes A1, A2. In some implementations, the inner surface 255-1 is disposed at an angle σ (e.g., greater than approximately five degrees and less than approximately one hundred seventy-five degrees) relative to the outer surface 255-2 such that the ground-engaging edge 259 defines a peak or ridge of the central ground-engaging member 254.

As illustrated in FIG. 3, in some implementations, the central ground-engaging member 254 includes a forward lobe 261-1 and a rearward lobe 261-2. For example, the inner and outer surfaces 255-1, 255-2 may define the forward lobe 261-1 and the rearward lobe 261-2. The forward and rearward lobes 261-1, 261-2 may define a substantially figure-eight shaped construct disposed in the forefoot portion 216 of the outsole 210. While the forward and rearward lobes 261-1, 261-2 are each illustrated as defining a rectangular or diamond shape, it will be appreciated that each of the forward and rearward lobes 261-1, 261-2 may define a triangular, circular, or other suitable shape within the scope of the present disclosure.

The ground-engaging edge 259 of the forward lobe 261-1 may include a forward-medial portion 259-1, a forward-lateral portion 259-2 extending from the forward-medial portion 259-1, a rearward-lateral portion 259-3 extending from the forward-lateral portion 259-2, and a rearward-medial portion 259-4 extending from the rearward-lateral portion 259-3 to the forward-medial portion 259-1. As previously described, while the forward-medial portion 259-1, the forward-lateral portion 259-2, the rearward-lateral portion 259-3, and the rearward-medial portion 259-4 are illustrated as collectively defining a rectangular or diamond shape, it will be appreciated that the forward-medial portion 259-1, the forward-lateral portion 259-2, the rearward-lateral portion 259-3, and the rearward-medial portion 259-4 may collectively define a triangular, circular, or other suitable shape within the scope of the present disclosure.

The ground-engaging edge 259 of the rearward lobe 261-2 may include a forward-medial portion 259-5, a forward-lateral portion 259-6 extending from the forward-medial portion 259-5, a rearward-lateral portion 259-7 extending from the forward-lateral portion 259-6, and a rearward-medial portion 259-8 extending from the rearward-lateral portion 259-7 to the forward-medial portion 259-5. As previously described, while the forward-medial portion 259-5, the forward-lateral portion 259-6, the rearward-lateral portion 259-7, and the rearward-medial portion 259-8 are illustrated as collectively defining a rectangular or diamond shape, it will be appreciated that the forward-medial portion 259-5, the forward-lateral portion 259-6, the rearward-lateral portion 259-7, and the rearward-medial portion 259-8 may collectively define a triangular, circular, or other suitable shape within the scope of the present disclosure.

The ground-engaging edge 259 of the central ground-engaging member 254 may taper toward or away from the ground engaging surface 214 such that a distance H between the ground-engaging surface 214 and the ground-engaging edge 259, in a direction extending substantially parallel to the axis A3, varies along the length of the ground-engaging edge 259. In some implementations, the distance H between the ground-engaging surface 214 and the ground-engaging edge 259 defined by the forward-most location of the ground-engaging edge 259 (e.g., a location of the ground-engaging edge 259 disposed closest to the forefoot portion 216) or a rearward-most location of the ground-engaging edge 259 (e.g., a location of the ground-engaging edge 259 disposed closest to the heel portion 220) is greater than the distance H between the ground-engaging surface 214 and the ground-engaging edge 259 defined by a central location of the ground-engaging edge 259 (e.g., a location of the ground-engaging edge 259 disposed between the forward-most and rearward-most locations of the ground-engaging edge 259).

In some implementations, the forward-medial portion 259-1 tapers toward the ground engaging surface 214 in a direction extending toward the medial side 224 or heel portion 220. In some implementations, the forward-medial portion 259-1 tapers toward the ground engaging surface 214 in a direction extending from the forward-lateral portion 259-2 to the rearward-medial portion 259-4.

The forward-lateral portion 259-2 may taper toward the ground engaging surface 214 in a direction extending toward the lateral side 222 or heel portion 220. In some implementations, the forward-lateral portion 259-2 tapers toward the ground engaging surface 214 in a direction extending from the forward-medial portion 259-1 to the rearward-lateral portion 259-3.

The rearward-lateral portion 259-3 may taper toward the ground engaging surface 214 in a direction extending toward the medial side 224 or heel portion 220. In some implementations, the rearward-lateral portion 259-3 tapers toward the ground engaging surface 214 in a direction extending from the forward-lateral portion 259-2 to the rearward-medial portion 259-4.

The rearward-medial portion 259-4 may taper toward the ground engaging surface 214 in a direction extending toward the lateral side 222 or heel portion 220. In some implementations, the rearward-medial portion 259-4 tapers toward the ground engaging surface 214 in a direction extending from the forward-medial portion 259-1 to the rearward-lateral portion 259-3.

The forward-medial portion 259-5 may taper toward the ground engaging surface 214 in a direction extending toward the lateral side 222 or forefoot portion 216. In some implementations, the forward-medial portion 259-5 tapers toward the ground engaging surface 214 in a direction extending from the rearward-medial portion 259-8 to the forward-lateral portion 259-6.

The forward-lateral portion 259-6 may taper toward the ground engaging surface 214 in a direction extending toward the medial side 224 or forefoot portion 216. In some implementations, the forward-lateral portion 259-6 tapers toward the ground engaging surface 214 in a direction extending from the rearward-lateral portion 259-7 to the forward-medial portion 259-5.

The rearward-lateral portion 259-7 may taper toward the ground engaging surface 214 in a direction extending toward the lateral side 222 or forefoot portion 216. In some implementations, the rearward-lateral portion 259-7 tapers toward the ground engaging surface 214 in a direction extending from the rearward-medial portion 259-8 to the forward-lateral portion 259-6.

The rearward-medial portion 259-8 may taper toward the ground engaging surface 214 in a direction extending toward the medial side 224 or forefoot portion 216. In some implementations, the rearward-medial portion 259-8 tapers toward the ground engaging surface 214 in a direction extending from the rearward-lateral portion 259-7 to the forward-medial portion 259-5.

The flange 256 may be disposed proximate to at least a portion of the perimeter 232 of the outsole 210. In this regard, the flange 256 may extend around at least a portion of the ground-engaging surface 214. For example, the flange 256 may surround the ground-engaging surface 214. As illustrated in FIG. 4A, in some implementations, the flange 256 extends from the outsole 210 and away from the inner surface 212 along an axis A4 in a cross-section taken along the axis A3. The axis A4 may define an angle α relative to the axis A1. The angle α may be between approximately zero degrees and approximately forty degrees. In this regard, the angle α may vary between approximately zero degrees and approximately forty degrees depending on the location at which the cross section is taken, such that the flange 256 tapers inwardly (e.g., toward a center of the outsole 210) or otherwise defines a portion of a frustoconical shape. For example, as illustrated in FIG. 4A, in a cross section taken through the axes A2, A3, the angle α may be between approximately two degrees and approximately ten degrees in the resting configuration. In some implementations, the axis A4 may extend in a direction substantially parallel (+/−five degrees) to the radius of curvature R2 of the ground-engaging surface 214 in the resting configuration.

The peripheral ground-engaging member(s) 258 may extend from the flange 256 or the ground-engaging surface 214. As illustrated in FIG. 4A, in some implementations, the peripheral ground-engaging member(s) 258 extend from the flange 256 and away from the ground-engaging surface 214 along the axis A4 in a cross-section taken along the axis A3, such that a distal end 260 of the central ground-engaging member(s) 254 and a distal end 262 of the peripheral ground-engaging member(s) 258 define a distance X extending therebetween. In the resting configuration, the distance X may be between approximately one millimeter and approximately ten millimeters. In some implementations, the distance X is substantially equal to five millimeters.

During operation or use of the article of footwear 10 (e.g., the outsole 210), a force may be applied to the outsole 210. For example, as illustrated in FIG. 4B, a wearer's foot may apply a force F1 to the inner surface 212 of the outsole 210. At least a portion of the force F1 may extend along (e.g., substantially parallel to) one or both of the radii of curvature R1*r*, R2*r* of the outsole 210. When the portion of the force F1 extending along one or both of the radii of curvature R1*r*, R2*r* is greater than a predetermined threshold (e.g., greater than approximately twenty pounds-force), the outsole may flex, causing one or both of the radii of curvature R1*r*, R2*r* to increase until the outsole 210 is in a flexed configuration (e.g., FIG. 4B). In this regard, in the flexed configuration, the inner surface 212 and the ground-engaging surface 214 may define radii of curvature R1*f*, R2*f* that are greater than the corresponding radii of curvature R1*r*, R2*r* defined by the resting configuration. In some implementations, the inner surface 212 or the ground-engaging surface 214 may be substantially planar in the flexed configuration, such that the radii of curvature R1*f*, R2*f* are substantially infinite. In the flexed configuration, the outsole 210 may be biased towards the resting configuration by a reaction force F2 produced by the ground and extending in a direction opposite the force F1.

Accordingly, as the outsole 210 flexes from the resting configuration to the flexed configuration, one or both of the distance X and the angle α may decrease. For example, in the flexed configuration, the distance X may be less than five millimeters, and the angle α may be less than five degrees. In some implementations, the distance X is substantially equal to zero millimeters and the angle α is substantially equal to zero degrees in the flexed configuration. In this regard, the axis A4 corresponding to at least a portion of the flange 256 and one or more of the peripheral ground-engaging members 258 may be substantially parallel to the axis A3 in the flexed configuration. For example, axis A4 corresponding to the portion of the flange 256 aligned with the lateral or medial sides 222, 224, or the peripheral ground-engaging members 258 disposed along the lateral or medial sides 222, 224, may be substantially parallel to the axis A3 in the flexed configuration. Accordingly, in the flexed configuration, the flange 256, the ground-engaging members 258, or the ground-engaging member(s) 254 may provide improved traction between the footwear 10 and the ground. For example, in the resting configuration, the rearward-lateral portion 259-3, rearward-medial portion 259-4, forward-medial portion 259-5, or forward-lateral portion 259-6 of the ground-engaging edge 259 may be disengage from the ground, such that the ground and the rearward-lateral portion 259-3, rearward-medial portion 259-4, forward-medial portion 259-5, or forward-lateral portion 259-6 of the ground-engaging edge 259 define a gap (e.g., a void), whereas in the flexed configuration, the rearward-lateral portion 259-3, rearward-medial portion 259-4, forward-medial portion 259-5, or forward-lateral portion 259-6 of the ground-engaging edge 259 may engage the ground to provide better traction between the ground-engaging member(s) 254 and the ground.

The material of the outsole 210 causes the outsole 210 to be biased into the relaxed configuration. As such, when the force applied to the outsole 210 is removed, the outsole 210 automatically returns to the relaxed configuration. Namely, the outsole 210 may be formed from a relatively rigid but flexible material that causes the outsole 210 to automatically return to the relaxed configuration when the force applied to the outsole 210 is removed. As such, the material of the outsole 210 along with the concave profile of the ground-engaging surface 214 causes the outsole 210 to automatically snap back from the flexed configuration to the relaxed configuration and, in so doing, aide in propelling the wearer.

Figure 5:
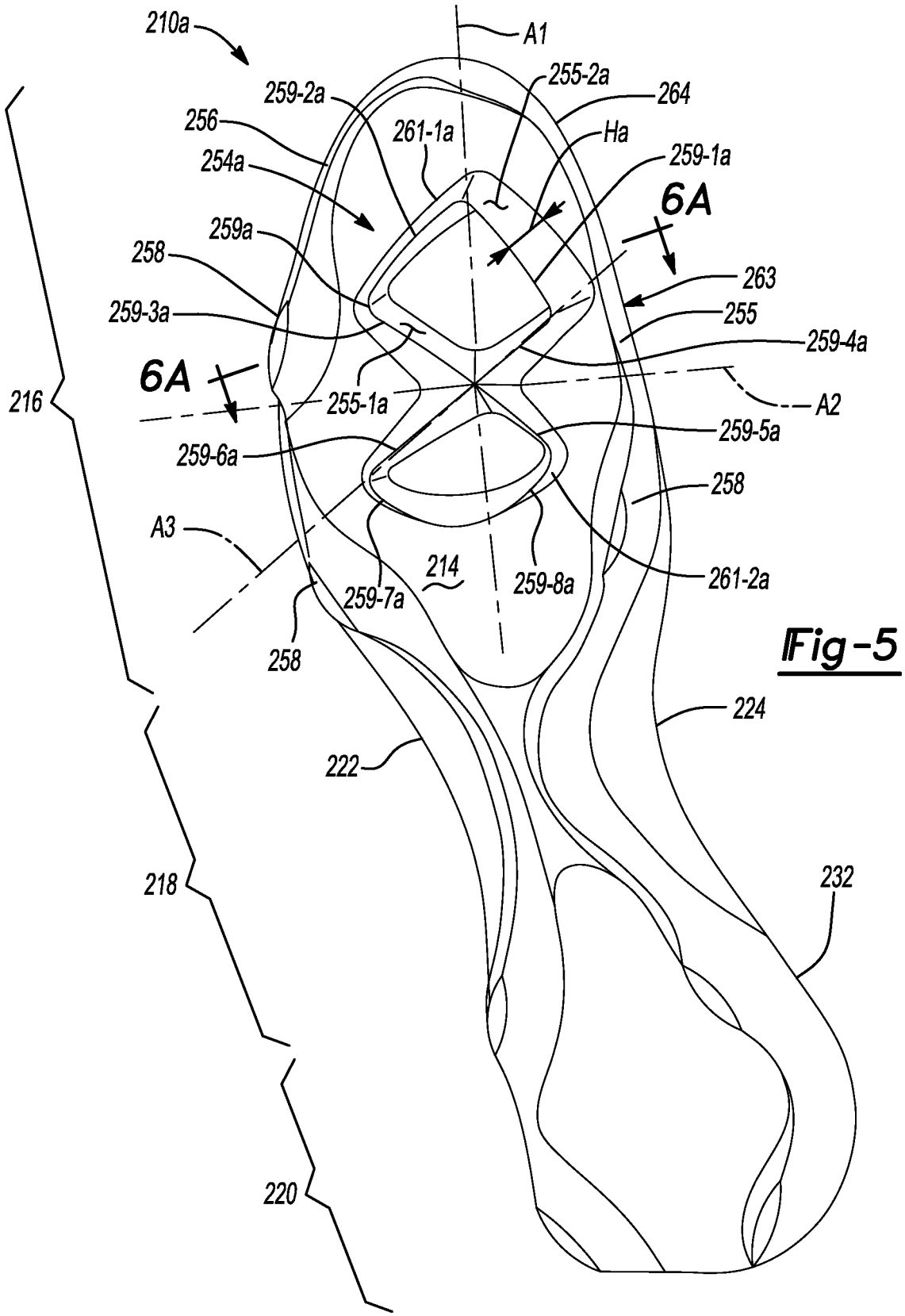
FIG. 5 is a perspective view of another outsole in accordance with principles of the present disclosure.
Figure 6A:
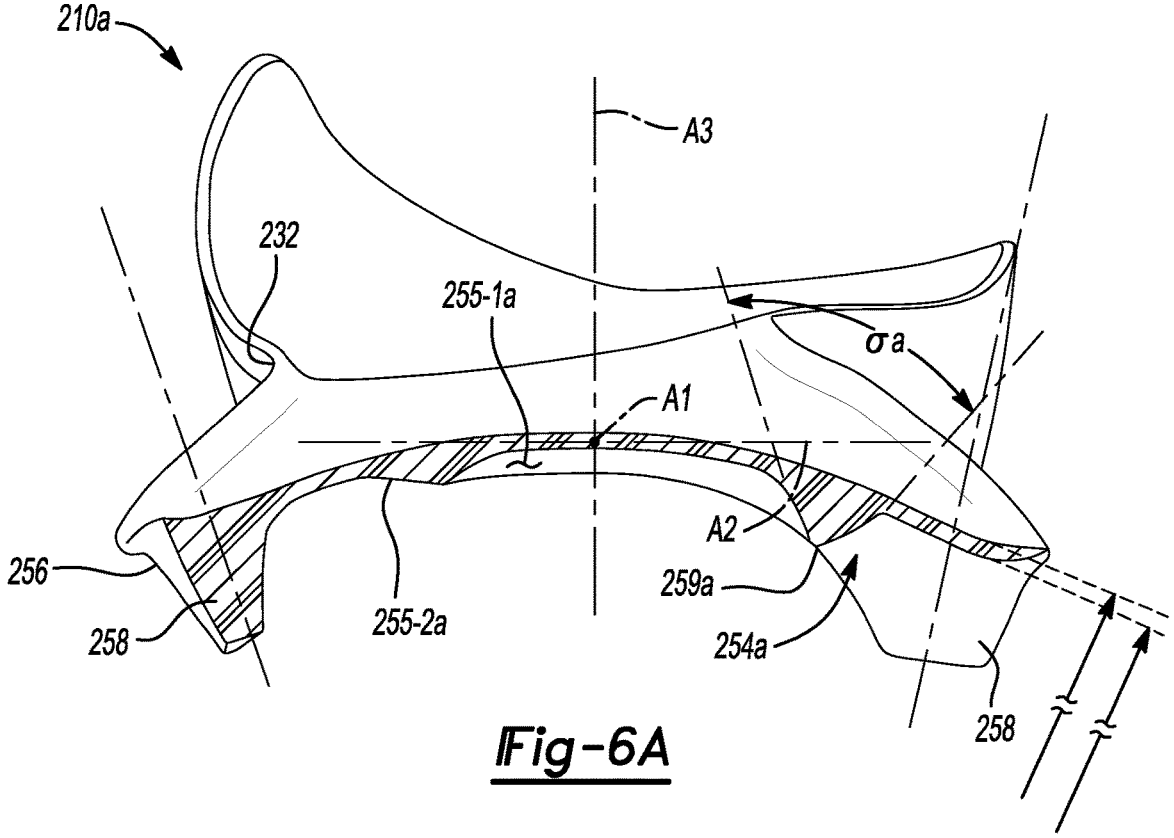
FIG. 6A is a cross-sectional view of the outsole of FIG. 5 taken through the line 6A-6A and showing the outsole in a relaxed configuration.
Figure 6B:
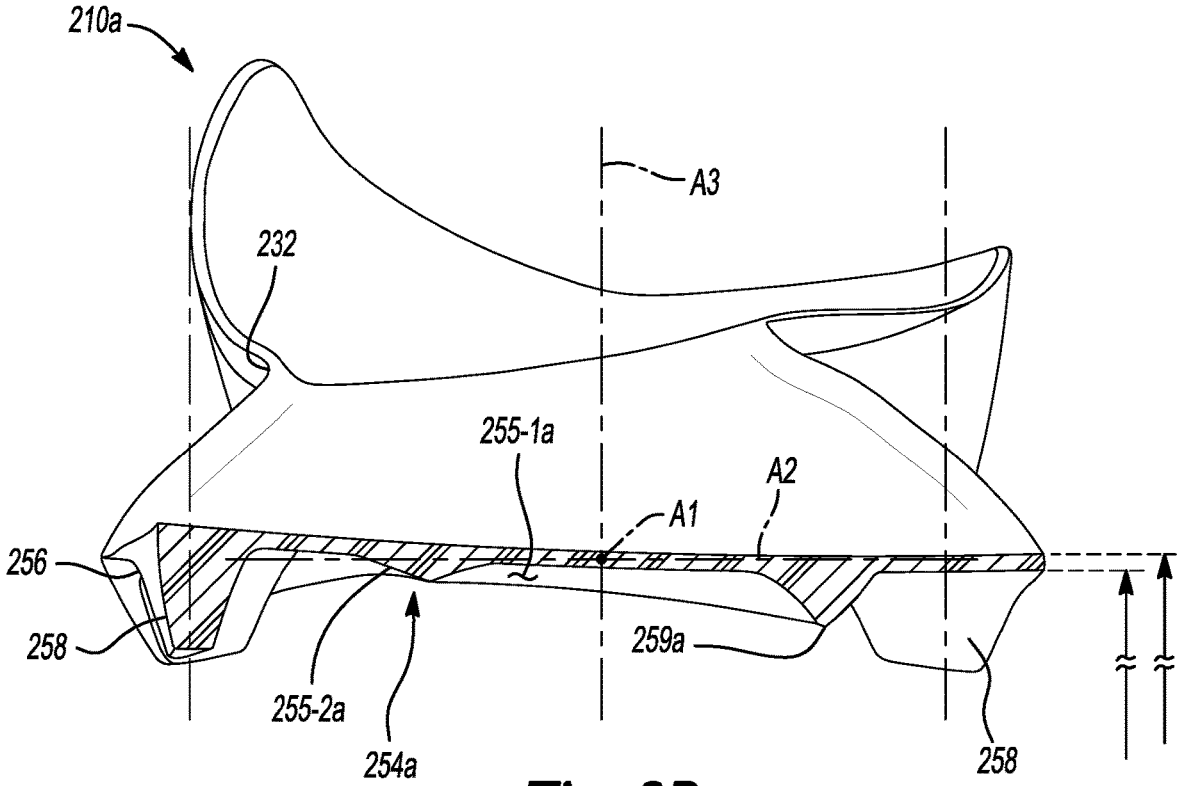
FIG. 6B is a cross-sectional view of the outsole of FIG. 5 showing the outsole in a flexed configuration.

Referring to FIGS. 5-6B, another outsole 210*a* for use with the article of footwear 10 is illustrated. The outsole 210*a* may be substantially similar to the outsole 210 except as otherwise shown or described herein. Accordingly, the structure and function of similar features will not be described again in detail. In addition, like reference numerals are used hereinafter and in the drawings to identify like features, while like reference numerals containing letter extensions (i.e., "a") are used to identify those features that have been modified.

The outsole 210*a* may include one or more central ground-engaging members 254*a*, the flange 256, and the one or more peripheral ground-engaging members 258. The central ground-engaging member(s) 254*a* may include an inner surface 255-1*a* and an outer surface 255-2*a* extending from the ground-engaging surface 214 to a ground-engaging edge 259*a*. The inner and outer surfaces 255-1*a*, 255-2*a* may extend in a direction transverse to the axes A1, A2. In some implementations, the inner surface 255-1*a* is disposed at an angle σa (e.g., greater than approximately five degrees and less than approximately one hundred seventy-five degrees) relative to the outer surface 255-2*a* such that the ground-engaging edge 259*a* defines a peak or ridge of the central ground-engaging member 254*a*.

As illustrated in FIG. 5, in some implementations, the central ground-engaging member 254*a* includes a forward lobe 261-1*a* and a rearward lobe 261-2*a*. For example, the inner and outer surfaces 255-1*a*, 255-2*a* may define the forward lobe 261-1*a* and the rearward lobe 261-2*a*. The forward and rearward lobes 261-1*a*, 261-2*a* may define a substantially figure-eight shaped construct disposed in the forefoot portion 12. While the forward and rearward lobes 261-1*a*, 261-2*a* are each illustrated as defining a rectangular or diamond shape, it will be appreciated that each of the forward and rearward lobes 261-1*a*, 261-2*a* may define a triangular, circular, or other suitable shape within the scope of the present disclosure.

The ground-engaging edge 259*a* of the forward lobe 261-1*a* may include a forward-medial portion 259-1*a*, a forward-lateral portion 259-2*a* extending from the forward-medial portion 259-1*a*, a rearward-lateral portion 259-3*a* extending from the forward-lateral portion 259-2*a*, and a rearward-medial portion 259-4*a* extending from the rearward-lateral portion 259-3*a* to the forward-medial portion 259-1*a*. As previously described, while the forward-medial portion 259-1*a*, the forward-lateral portion 259-2*a*, the rearward-lateral portion 259-3*a*, and the rearward-medial portion 259-4*a* are illustrated as collectively defining a rectangular or diamond shape, it will be appreciated that the forward-medial portion 259-1*a*, the forward-lateral portion 259-2*a*, the rearward-lateral portion 259-3*a*, and the rearward-medial portion 259-4*a* may collectively define a triangular, circular, or other suitable shape within the scope of the present disclosure.

The ground-engaging edge 259*a* of the rearward lobe 261-2*a* may include a forward-medial portion 259-5*a*, a forward-lateral portion 259-6*a* extending from the forward-medial portion 259-5*a*, a rearward-lateral portion 259-7*a* extending from the forward-lateral portion 259-6*a*, and a rearward-medial portion 259-8*a* extending from the rearward-lateral portion 259-7*a* to the forward-medial portion 259-5*a*. As previously described, while the forward-medial portion 259-5*a*, the forward-lateral portion 259-6*a*, the rearward-lateral portion 259-7*a*, and the rearward-medial portion 259-8*a* are illustrated as collectively defining a rectangular or diamond shape, it will be appreciated that the forward-medial portion 259-5*a*, the forward-lateral portion 259-6*a*, the rearward-lateral portion 259-7*a*, and the rearward-medial portion 259-8*a* may collectively define a triangular, circular, or other suitable shape within the scope of the present disclosure.

The ground-engaging edge 259*a* of the central ground-engaging member 254*a* may taper toward or away from the ground engaging surface 214 such that a distance Ha between the ground-engaging surface 214 and the ground-engaging edge 259*a*, in a direction extending substantially parallel to the axis A3, varies along the length of the ground-engaging edge 259*a*. In some implementations, the distance Ha between the ground-engaging surface 214 and the ground-engaging edge 259*a* defined by a medial-most location of the ground-engaging edge 259*a* (e.g., a location of the ground-engaging edge 259*a* disposed closest to the medial side 224) or a lateral-most location of the ground-engaging edge 259*a* (e.g., a location of the ground-engaging edge 259 disposed closest to the lateral side 222) is greater than the distance Ha between the ground-engaging surface 214 and the ground-engaging edge 259*a* defined by a central location of the ground-engaging edge 259*a* (e.g., a location of the ground-engaging edge 259*a* disposed between the forward-most, rearward-most, lateral-most, and medial-most locations of the ground-engaging edge 259*a*).

In some implementations, the forward-medial portion 259-1*a* tapers toward the ground engaging surface 214 in a direction extending toward the lateral side 222 or forefoot portion 216. In some implementations, the forward-medial portion 259-1*a* tapers toward the ground engaging surface 214 in a direction extending from the rearward-medial portion 259-4*a* to the forward-lateral portion 259-2*a*.

The forward-lateral portion 259-2*a* may taper toward the ground engaging surface 214 in a direction extending toward the medial side 224 or forefoot portion 216. In some implementations, the forward-lateral portion 259-2*a* tapers toward the ground engaging surface 214 in a direction extending from the rearward-lateral portion 259-3*a* to the forward-medial portion 259-1*a*.

The rearward-lateral portion 259-3*a* may taper toward the ground engaging surface 214 in a direction extending toward the medial side 224 or heel portion 220. In some implementations, the rearward-lateral portion 259-3*a* tapers toward the ground engaging surface 214 in a direction extending from the forward-lateral portion 259-2*a* to the rearward-medial portion 259-4*a*.

The rearward-medial portion 259-4*a* may taper toward the ground engaging surface 214 in a direction extending toward the lateral side 222 or heel portion 220. In some implementations, the rearward-medial portion 259-4*a* tapers toward the ground engaging surface 214 in a direction extending from the forward-medial portion 259-1*a* to the rearward-lateral portion 259-3*a*.

The forward-medial portion 259-5*a* may taper toward the ground engaging surface 214 in a direction extending toward the lateral side 224 or forefoot portion 216. In some implementations, the forward-medial portion 259-5*a* tapers toward the ground engaging surface 214 in a direction extending from the rearward-medial portion 259-8*a* to the forward-lateral portion 259-6*a*.

The forward-lateral portion 259-6*a* may taper toward the ground engaging surface 214 in a direction extending toward the medial side 224 or forefoot portion 216. In some implementations, the forward-lateral portion 259-6*a* tapers toward the ground engaging surface 214 in a direction extending from the rearward-lateral portion 259-7*a* to the forward-medial portion 259-5*a*.

The rearward-lateral portion 259-7*a* may taper toward the ground engaging surface 214 in a direction extending toward the lateral side 222 or forefoot portion 216. In some implementations, the rearward-lateral portion 259-7*a* tapers toward the ground engaging surface 214 in a direction extending from the rearward-medial portion 259-8*a* to the forward-lateral portion 259-6*a*.

The rearward-medial portion 259-8*a* may taper toward the ground engaging surface 214 in a direction extending toward the medial side 224 or forefoot portion 216. In some implementations, the rearward-medial portion 259-8*a* tapers toward the ground engaging surface 214 in a direction extending from the rearward-lateral portion 259-7*a* to the forward-medial portion 259-5*a*.

The flange 256*a* may be disposed proximate to at least a portion of a perimeter 232 of the outsole 210*a*. In some implementations, the flange 256*a* defines a gap or void 263 disposed along the medial side 224. In this regard, the flange 256*a* may extend from a proximal end 264 to a distal end 265 such that the ground-engaging surface 214 extends to the medial side 224. The proximal and distal ends 264, 265 may be disposed on the medial side 224 and define the void 263 therebetween.

Figure 7:
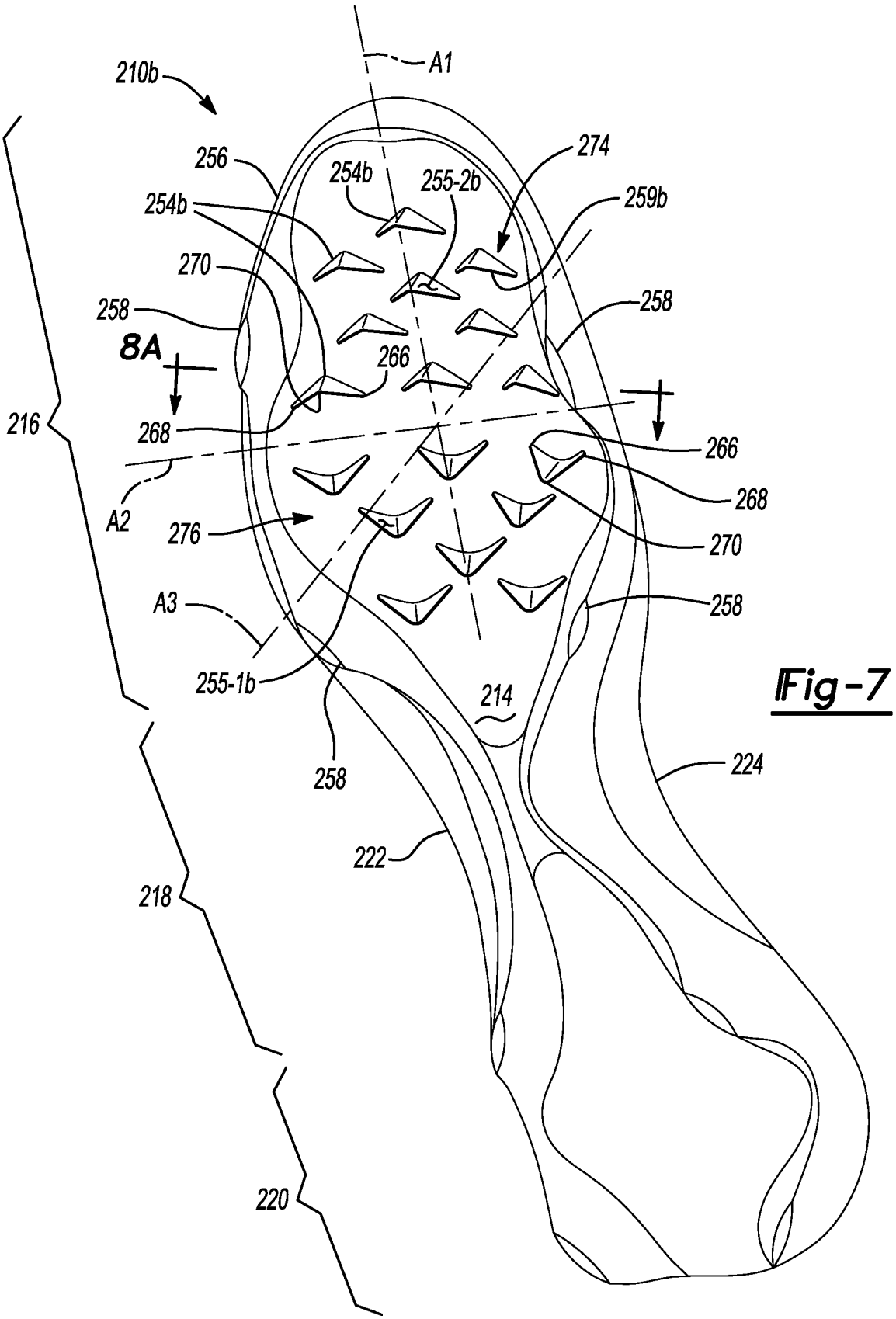
FIG. 7 is a perspective view of another outsole in accordance with principles of the present disclosure.
Figure 8A:
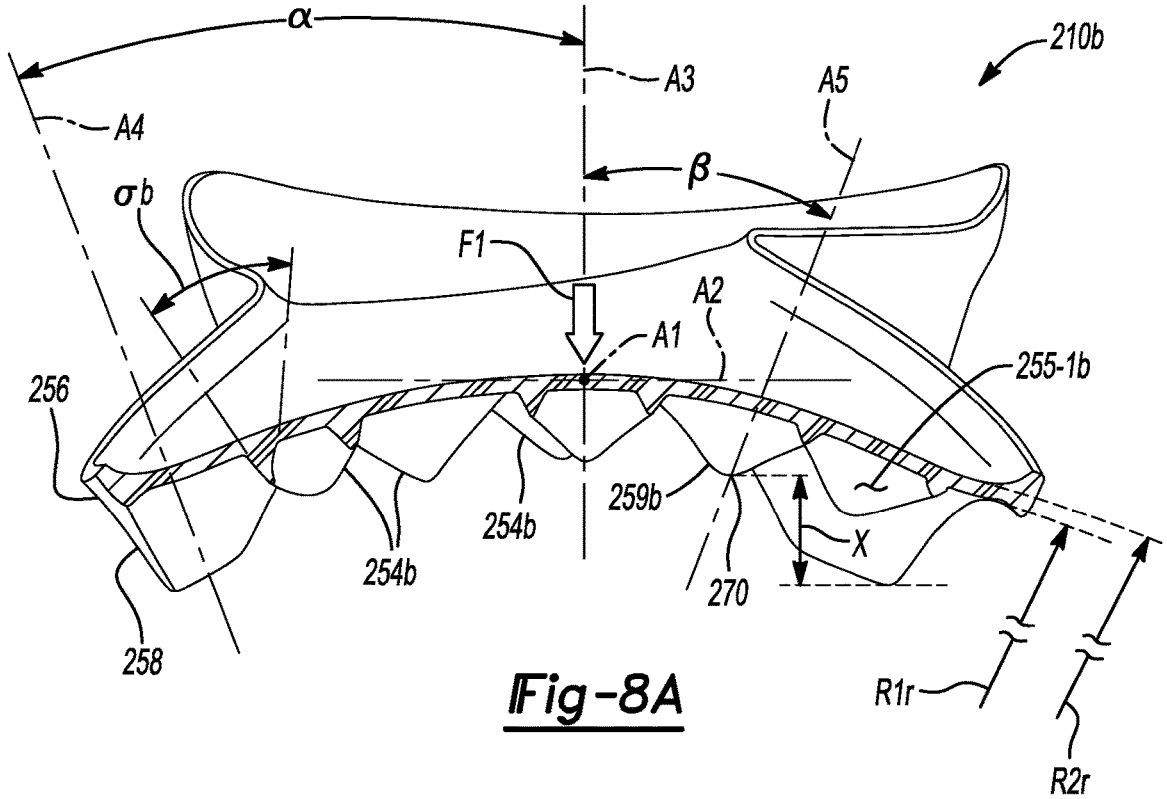
FIG. 8A is a cross-sectional view of the outsole of FIG. 7 taken through the line 8A-8A and showing the outsole in a relaxed configuration.
Figure 8B:
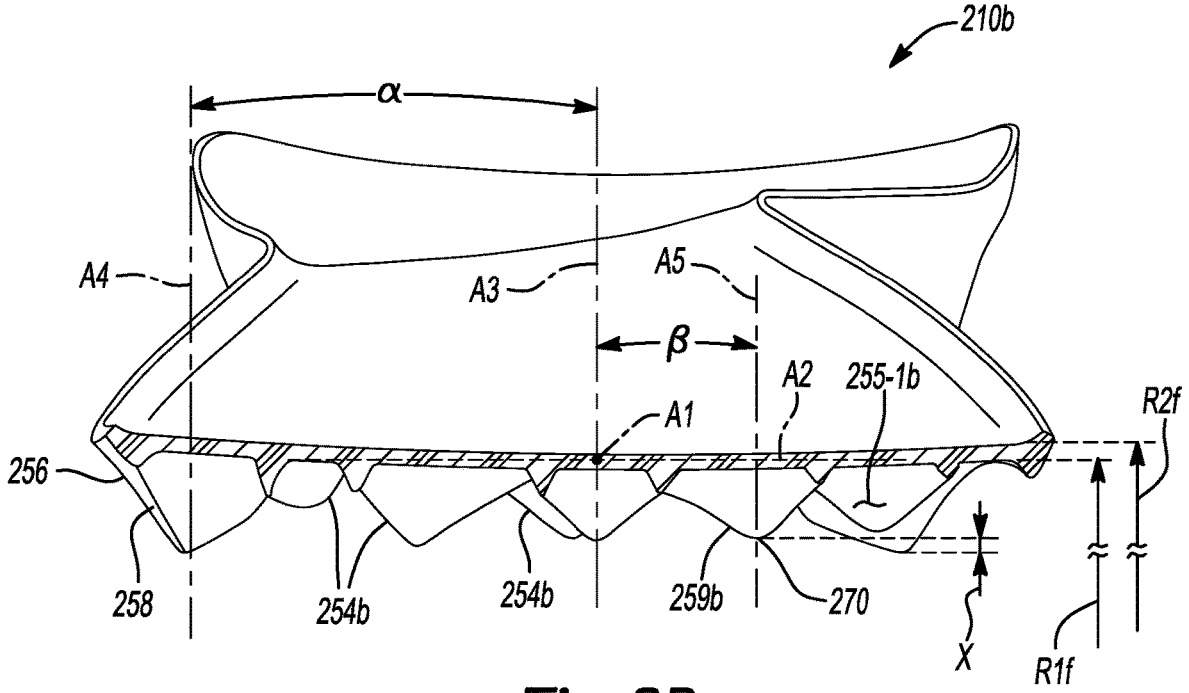
FIG. 8B is a cross-sectional view of the outsole of FIG. 7 showing the outsole in a flexed configuration.

Referring to FIGS. 7-8B, another outsole 210*b* for use with the article of footwear 10 is illustrated. The outsole 210*b* may be substantially similar to the outsole 210 except as otherwise shown or described herein. Accordingly, the structure and function of similar features will not be described again in detail. In addition, like reference numerals are used hereinafter and in the drawings to identify like features, while like reference numerals containing letter extensions (i.e., "b") are used to identify those features that have been modified.

The outsole 210*b* may include one or more central ground-engaging members 254*b*, the flange 256, and the one or more of the peripheral ground-engaging members 258. The central ground-engaging member(s) 254*b* may include an inner surface 255-1*b* and an outer surface 255-2*b* extending from the ground-engaging surface 214 to a ground-engaging edge 259*b*. The inner and outer surfaces 255-1*b*, 255-2*b* may extend in a direction transverse to the axes A1, A2. In some implementations, the inner surface 255-1*b* is disposed at an angle σb (e.g., greater than approximately five degrees and less than approximately one hundred seventy-five degrees) relative to the outer surface 255-2*b* such that the ground-engaging edge 259*b* defines a peak or ridge of the central ground-engaging member 254*b*. In some implementations, the inner surface 255-1*b* is concave and the outer surface 255-1*b* is convex.

As illustrated in FIG. 7, in some implementations, the central ground-engaging members 254*b* (e.g., the ground-engaging edge 259*b*) each define a substantially V-shaped construct having a proximal end 266, a distal end 268, and an apex 270 disposed between the proximal and distal ends 266, 268. For example, the ground-engaging edge 259*b* may taper towards the ground-engaging surface 214 from the apex 270 to the proximal end 266 and from the apex 270 to the distal end 268.

In some implementations, the central ground-engaging members 254*b* include a first set 274 of ground-engaging members 254*b* and a second set 276 of ground-engaging members 254*b*. The second set 276 of ground engaging members 254*b* may be disposed between the first set 274 and the heel portion 220 of the outsole 210*b*. The proximal and distal ends 266, 268 of each ground-engaging member 254*b* of the first set 274 of ground-engaging members 254*b* may be disposed between the apex 270 of the corresponding ground-engaging member 254*b* and the second set 276 of ground-engaging members 254, while the proximal and distal ends 266, 268 of each ground-engaging member 254*b* of the second set 276 of ground-engaging members 254*b* may be disposed between the apex 270 of the corresponding ground-engaging member 254*b* and the first set 274 of ground-engaging members 254*b*. In some implementations, the apex 270 of at least one of the ground-engaging members 254*b* of the first set 274 of ground-engaging members 254*b* and the apex 270 of at least one of the ground-engaging members 254*b* of the second set 276 of ground-engaging members 254*b* is disposed along the axis A1 of the outsole 210*b*. As used herein, the "apex" may refer to the location on the ground-engaging member 254*b* disposed the greatest distance from the ground-engaging surface 214. In this regard, as illustrated in FIG. 8A, each ground-engaging member 254*b* may extend from the ground-engaging surface 214 to the respective apex 270 along an axis A5. In some implementations, the axis A5 may extend in a direction substantially perpendicular to the radii of curvature R1*r*, R2*r*. Accordingly, the axis A5 of one or more of the ground-engaging members 254*b* may define an angle β relative to the axis A3.

During operation or use of the article of footwear 10 (e.g., the outsole 210*b*), the force F1 may be applied to the outsole 210*b*, as previously described, until the outsole 210*b* is in a flexed configuration (e.g., FIG. 8B). As the outsole 210*b* flexes from the resting configuration to the flexed configuration, one or more of the distance X, the angle α, and the angle β may decrease. For example, in the flexed configuration, the distance X may be less than approximately five millimeters, and the angles α or β may be less than approximately five degrees. In some implementations, the distance X is substantially equal to zero millimeters and the angles α and β are substantially equal to zero degrees in the flexed configuration. In this regard, the axes A4 and A5 corresponding to at least a portion of the flange 256 and one or more of the ground-engaging members 254*b*, respectively, may be substantially parallel to the axis A3 in the flexed configuration. Accordingly, in the flexed configuration, the flange 256, the ground-engaging members 258, or the ground-engaging members 254*b* may provide improved traction between the outsole 210*b* and the ground.

Figure 9:
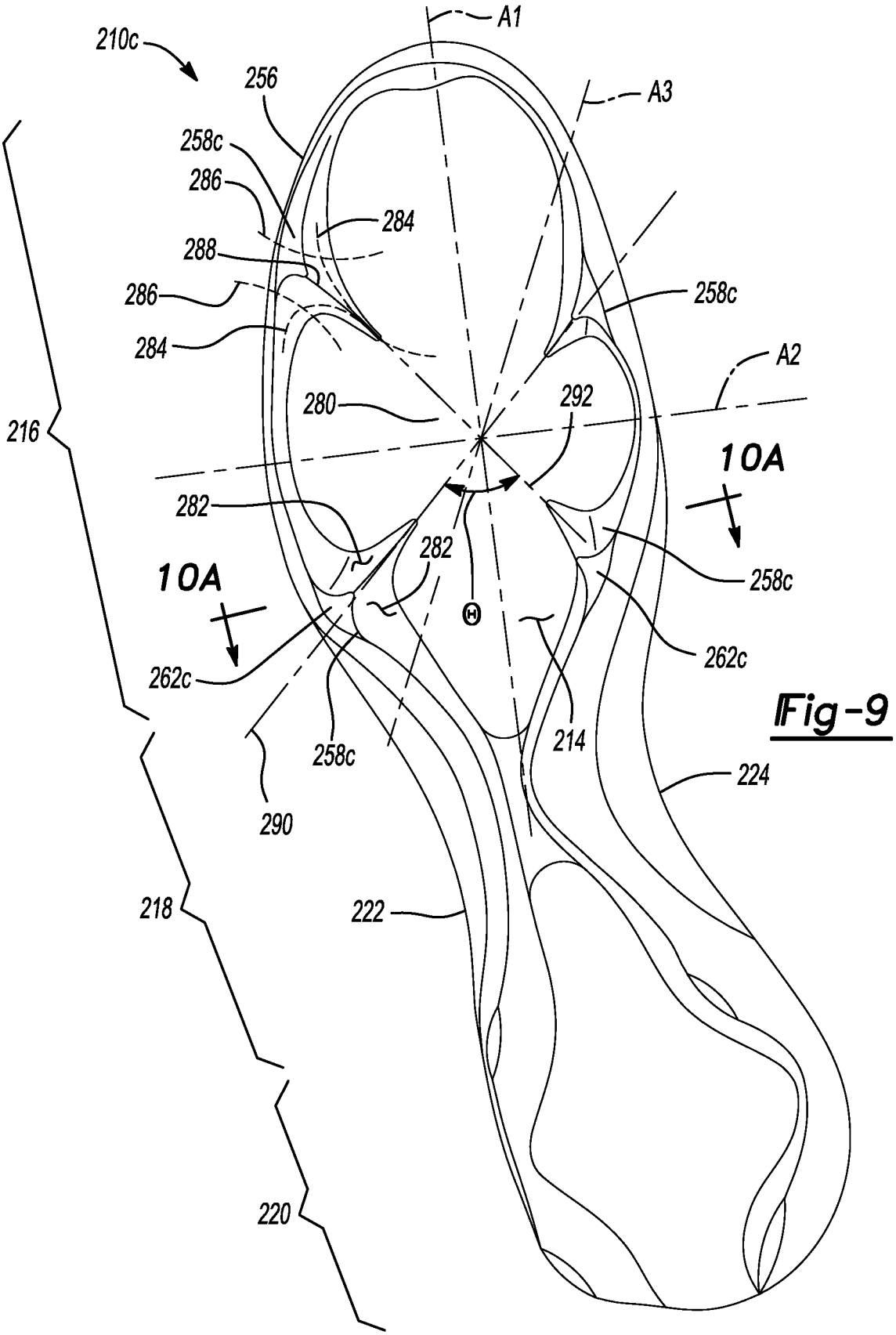
FIG. 9 is a perspective view of another outsole in accordance with principles of the present disclosure.
Figure 10A:
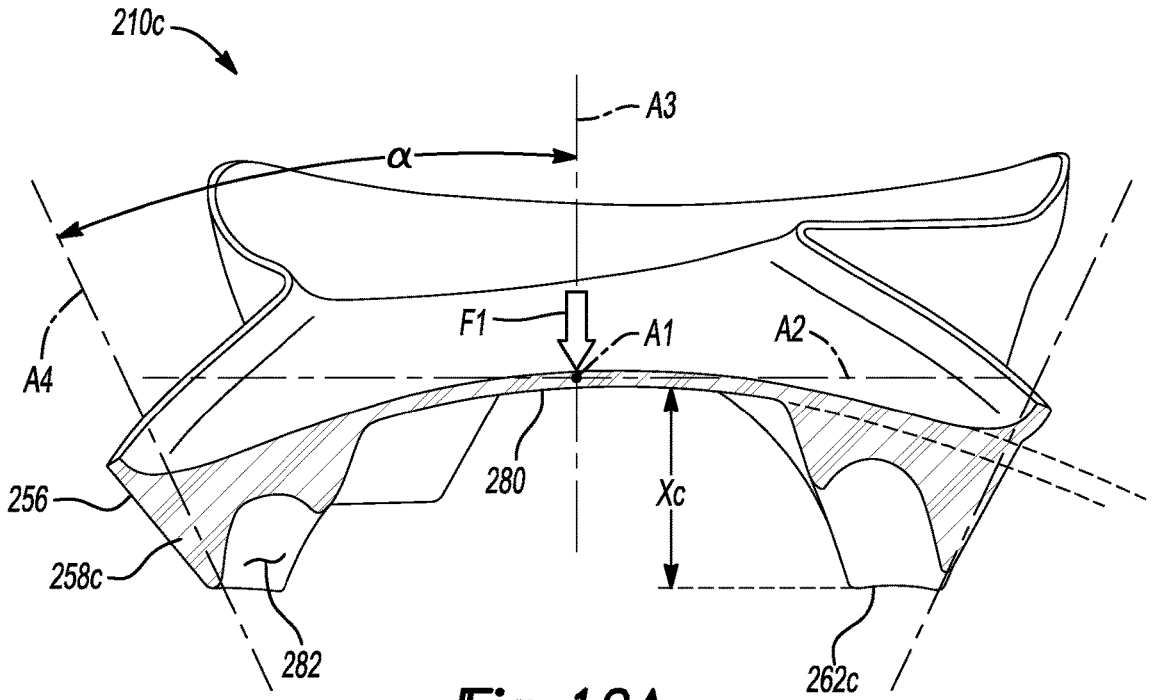
FIG. 10A is a cross-sectional view of the outsole of FIG. 9 taken through the line 10A-10A and showing the outsole in a relaxed configuration.
Figure 10B:
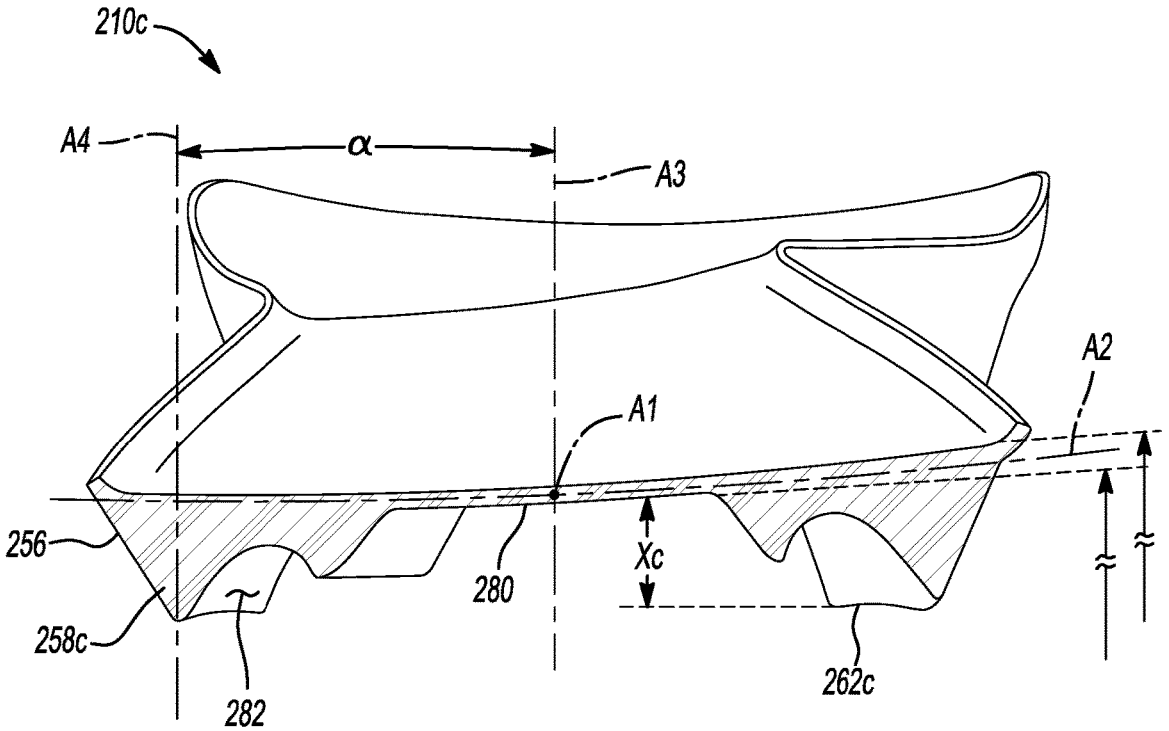
FIG. 10B is a cross-sectional view of the outsole of FIG. 9 showing the outsole in a flexed configuration.

Referring to FIGS. 9-10B, another outsole 210*c* for use with the article of footwear 10 is illustrated. The outsole 210*c* may be substantially similar to the outsole 210 except as otherwise shown or described herein. Accordingly, the structure and function of similar features will not be described again in detail. In addition, like reference numerals are used hereinafter and in the drawings to identify like features, while like reference numerals containing letter extensions (i.e., "c") are used to identify those features that have been modified.

The outsole 210*c* may include the flange 256 having one or more peripheral ground-engaging members 258*c*. The peripheral ground-engaging member(s) 258*c* may extend from the flange 256 or the ground-engaging surface 214 in a direction transverse to the axes A1, A2. For example, as illustrated in FIG. 10A, the peripheral ground-engaging member(s) 258*c* may extend from the flange 256 and away from the ground-engaging surface 214 along the axis A4 in a cross section taken perpendicular to the axis A1, such that a central portion 280 of the ground-engaging surface 214 and a distal end 262*c* of the peripheral ground-engaging member(s) 258*c* define a distance Xc extending therebetween. In some implementations, the distal end 262*c* is substantially planar. In the resting configuration, the distal ends 262*c* of the peripheral ground-engaging members 254*c* may extend in a direction transverse to a plane defined by the axes A1, A2.

As illustrated in FIG. 9, in some implementations, the peripheral ground-engaging members 254*c* include a pair of surfaces 282 extending from the ground-engaging surface 214 to the distal end 262*c*. In some implementations, the surface 282 defines a generally horizontally extending concave arc 284 and a generally vertically-extending concave arc 286. The pair of surfaces 282 may define an edge 286 tapering towards the ground-engaging surface 214 from the distal end 262*c*. In some implementations, the edge 286 is concave.

The outsole 210*c* may include four peripheral ground-engaging members 254*c* disposed in the forefoot portion 216 of the outsole 210*c*. In some implementations, the edge 286 of a first of the peripheral ground-engaging members 254*c* is aligned with the edge 286 of a second of the peripheral ground-engaging members 254*b*, and the edge 286 of a third of the peripheral ground-engaging members 254*c* is aligned with the edge 286 of a fourth of the peripheral ground-engaging members 254*c*. In this regard, the edges 286 of the first and second peripheral ground-engaging members 254*c* may define, or otherwise be aligned with, a line 288, and the edges 286 of the third and fourth peripheral ground-engaging members 254*c* may define, or otherwise be aligned with, a line 290. The line 288 may intersect the line 290 proximate to the central portion 280 of the ground-engaging surface 214, such that the line 288 and the line 290 define an angle θ therebetween. The angle θ may be between approximately sixty degrees and approximately one hundred twenty degrees. In some implementation, the angle θ is substantially equal to ninety degrees.

During operation or use of the article of footwear 10 (e.g., the outsole 210*c*), the force F1 may be applied to the outsole 210*c*, as previously described, until the outsole 210*c* is in a flexed configuration (e.g., FIG. 10B). As the outsole 210*c* flexes from the resting configuration to the flexed configuration, one or both of the distance Xc and the angle α may decrease. For example, in the flexed configuration, the distance Xc may be less than approximately five millimeters, and the angle α may be less than approximately five degrees. In this regard, the axis A4 may be substantially parallel to the axis A3 in the flexed configuration, such that the distal ends 262*c* of the peripheral ground-engaging members 254*c* are substantially coplanar. Accordingly, in the flexed configuration, the flange 256 or the ground-engaging members 254*c* may provide improved traction between the footwear 10 and the ground.

The following Clauses provide exemplary configurations of the sole structure and article of footwear described above.

Clause 1. A sole structure for an article of footwear, the sole structure comprising (i) a plate having a concave ground-engaging surface extending between a medial side of the plate and a lateral side of the plate and movable between a relaxed state and a flexed state, the concave ground-engaging surface having an increased radius when moved from the relaxed state to the flexed state; (ii) a first ground-engaging member extending from the plate proximate to the medial side of the plate; and (iii) a second ground-engaging member extending from the plate proximate to the lateral side of the plate, the second ground-engaging member being spaced apart from the first ground-engaging member by a first distance when the plate is in the relaxed state and being spaced apart from the first ground-engaging member by a second distance greater than the first distance when the plate is in the flexed state.

Clause 2. The sole structure of Clause 1, wherein the plate includes a convex surface disposed on an opposite side of the plate than the concave ground-engaging surface.

Clause 3. The sole structure of Clause 2, wherein the convex surface extends between the medial side and the lateral side.

Clause 4. The sole structure of any of the preceding clauses, further comprising a third ground-engaging member extending from the plate in an area between the first ground-engaging member and the second ground-engaging member.

Clause 5. The sole structure of Clause 4, wherein the third ground-engaging member includes a substantially figure-eight shape.

Clause 6. The sole structure of Clause 4, wherein the third ground-engaging member includes a first surface and a second surface that meet at an apex.

Clause 7. The sole structure of Clause 6, wherein one of the first surface and the second surface is concave and the other of the first surface and the second surface is convex.

Clause 8. The sole structure of any of the preceding clauses, wherein the first ground-engaging member extends from the plate along a first axis and the second ground-engaging member extends from the plate along a second axis, the first axis being convergent with the second axis when the plate is in the relaxed state.

Clause 9. The sole structure of Clause 8, wherein the first axis is substantially parallel with the second axis when the plate is in the flexed state.

Clause 10. The sole structure of any of the preceding clauses, wherein at least one of the first ground-engaging member and the second ground-engaging member are disposed at a peripheral edge of the plate.

Clause 11. A sole structure for an article of footwear, the sole structure comprising (i) a plate having a concave ground-engaging surface extending between a medial side of the plate and a lateral side of the plate and movable between a relaxed state and a flexed state, the concave ground-engaging surface having an increased radius when moved from the relaxed state to the flexed state; (ii) a first ground-engaging member extending from the plate proximate to the medial side of the plate along a first axis; and (iii) a second ground-engaging member extending from the plate proximate to the lateral side of the plate along a second axis, the second axis being convergent with the first axis when the plate is in the relaxed state.

Clause 12. The sole structure of Clause 11, wherein the plate includes a convex surface disposed on an opposite side of the plate than the concave ground-engaging surface.

Clause 13. The sole structure of Clause 12, wherein the convex surface extends between the medial side and the lateral side.

Clause 14. The sole structure of any of the preceding clauses, further comprising a third ground-engaging member extending from the plate in an area between the first ground-engaging member and the second ground-engaging member.

Clause 15. The sole structure of Clause 14, wherein the third ground-engaging member includes a substantially figure-eight shape.

Clause 16. The sole structure of Clause 14, wherein the third ground-engaging member includes a first surface and a second surface that meet at an apex.

Clause 17. The sole structure of Clause 16, wherein one of the first surface and the second surface is concave and the other of the first surface and the second surface is convex.

Clause 18. The sole structure of any of the preceding clauses, wherein the first ground-engaging member is spaced apart from the second ground-engaging member by a first distance when the plate is in the relaxed state and is spaced apart from the second ground-engaging member by a second distance greater than the first distance when the plate is in the flexed state.

Clause 19. The sole structure of any of the preceding clauses, wherein the first axis is substantially parallel with the second axis when the plate is in the flexed state.

Clause 20. The sole structure of any of the preceding clauses, wherein at least one of the first ground-engaging member and the second ground-engaging member are disposed at a peripheral edge of the plate.

Clause 21. A sole structure for an article of footwear, the sole structure comprising (i) a plate having a concave ground-engaging surface extending between a medial side of the plate and a lateral side of the plate and movable between a relaxed state and a flexed state, the concave ground-engaging surface having an increased radius when moved from the relaxed state to the flexed state; (ii) a first ground-engaging member extending from the plate proximate to the medial side of the plate along a first axis; and (iii) a second ground-engaging member extending from the plate proximate to the lateral side of the plate along a second axis, the second axis being substantially parallel with the first axis when the plate is in the flexed state.

Clause 22. The sole structure of Clause 21, wherein the plate includes a convex surface disposed on an opposite side of the plate than the concave ground-engaging surface.

Clause 23. The sole structure of Clause 22, wherein the convex surface extends between the medial side and the lateral side.

Clause 24. The sole structure of any of the preceding clauses, further comprising a third ground-engaging member extending from the plate in an area between the first ground-engaging member and the second ground-engaging member.

Clause 25. The sole structure of Clause 24, wherein the third ground-engaging member includes a substantially figure-eight shape.

Clause 26. The sole structure of Clause 24, wherein the third ground-engaging member includes a first surface and a second surface that meet at an apex.

Clause 27. The sole structure of Clause 26, wherein one of the first surface and the second surface is concave and the other of the first surface and the second surface is convex.

Clause 28. The sole structure of any of the preceding clauses, wherein the first ground-engaging member is spaced apart from the second ground-engaging member by a first distance when the plate is in the relaxed state and is spaced apart from the second ground-engaging member by a second distance greater than the first distance when the plate is in the flexed state.

Clause 29. The sole structure of any of the preceding clauses, wherein the first axis is convergent with the second axis when the plate is in the relaxed state.

Clause 30. The sole structure of any of the preceding clauses, wherein at least one of the first ground-engaging member and the second ground-engaging member are disposed at a peripheral edge of the plate.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a plate having a concave ground-engaging surface extending between a medial side of the plate and a lateral side of the plate and movable between a relaxed state and a flexed state, the concave ground-engaging surface having an increased radius when moved from the relaxed state to the flexed state;

a first ground-engaging member extending from the plate proximate to the medial side of the plate;

a second ground-engaging member extending from the plate proximate to the lateral side of the plate, the second ground-engaging member being spaced apart from the first ground-engaging member by a first distance when the plate is in the relaxed state and being spaced apart from the first ground-engaging member by a second distance greater than the first distance when the plate is in the flexed state; and a third ground-engaging member disposed between the first ground-engaging member and the second ground-engaging member and including a first lobe and a second lobe aligned with the first lobe along a longitudinal axis of the plate extending from a forefoot portion of the sole structure to a heel portion of the sole structure, the first lobe and the second lobe defining a substantially figure-eight shape.

2. The sole structure of claim 1, wherein the plate includes a convex surface disposed on an opposite side of the plate than the concave ground-engaging surface.

3. The sole structure of claim 2, wherein the convex surface extends between the medial side and the lateral side.

4. The sole structure of claim 1, wherein the third ground-engaging member is disposed in a forefoot region of the sole structure.

5. The sole structure of claim 1, wherein the third ground-engaging member includes a first surface extending from the ground-engaging surface at an oblique angle to a ground-engaging edge and a second surface extending from the ground-engaging surface to the ground-engaging edge.

6. The sole structure of claim 5, wherein one of the first surface and the second surface is concave and the other of the first surface and the second surface is convex.

7. The sole structure of claim 1, wherein the first ground-engaging member extends from the plate along a first axis and the second ground-engaging member extends from the plate along a second axis, the first axis being convergent with the second axis when the plate is in the relaxed state.

8. The sole structure of claim 7, wherein the first axis is substantially parallel with the second axis when the plate is in the flexed state.

9. The sole structure of claim 1, wherein at least one of the first ground-engaging member and the second ground-engaging member is disposed at a peripheral edge of the plate.

10. A sole structure for an article of footwear, the sole structure comprising:

a plate having a concave ground-engaging surface extending between a medial side of the plate and a lateral side of the plate and movable between a relaxed state and a flexed state, the concave ground-engaging surface having an increased radius when moved from the relaxed state to the flexed state;

a first ground-engaging member extending from the plate proximate to the medial side of the plate along a first axis;

a second ground-engaging member extending from the plate proximate to the lateral side of the plate along a second axis, the second axis being convergent with the first axis when the plate is in the relaxed state; and a third ground-engaging member disposed between the medial side of the plate and the lateral side of the plate and including a first lobe and a second lobe disposed between the first lobe and a heel portion of the sole structure, the first lobe and the second lobe defining a substantially figure-eight shape.

11. The sole structure of claim 10, wherein the plate includes a convex surface disposed on an opposite side of the plate than the concave ground-engaging surface.

12. The sole structure of claim 11, wherein the convex surface extends between the medial side and the lateral side.

13. The sole structure of claim 10, wherein the third ground-engaging member is disposed in a forefoot region of the sole structure in an area between the first ground-engaging member and the second ground-engaging member.

14. The sole structure of claim 10, wherein the third ground-engaging member includes a first surface extending from the ground-engaging surface at an oblique angle to a ground-engaging edge and a second surface extending from the ground-engaging surface to the ground-engaging edge.

15. The sole structure of claim 14, wherein one of the first surface and the second surface is concave and the other of the first surface and the second surface is convex.

16. The sole structure of claim 10, wherein the first ground-engaging member is spaced apart from the second ground-engaging member by a first distance when the plate is in the relaxed state and is spaced apart from the second ground-engaging member by a second distance greater than the first distance when the plate is in the flexed state.

17. The sole structure of claim 10, wherein the first axis is substantially parallel with the second axis when the plate is in the flexed state.

18. The sole structure of claim 10, wherein at least one of the first ground-engaging member and the second ground-engaging member is disposed at a peripheral edge of the plate.

* * * * *